US005639351A

United States Patent [19]

Ilmarinen

[11] Patent Number: 5,639,351

[45] Date of Patent: Jun. 17, 1997

[54] PRESS SECTION OF A PAPER MACHINE, IN PARTICULAR FOR PRINTING PAPER QUALITIES

[75] Inventor: Antti Ilmarinen, Jyvaskyla, Finland

[73] Assignee: Valmet Corporation, Helsinki, Finland

[21] Appl. No.: 343,629

[22] Filed: Nov. 22, 1994

Related U.S. Application Data

[60] Continuation-in-part of Ser. No. 299,566, Sep. 1, 1994, Pat. No. 5,522,959, which is a division of Ser. No. 995,053, Dec. 22, 1992, abandoned.

[30] Foreign Application Priority Data

Dec. 23, 1991 [FI] Finland ..... 916100

[51] Int. Cl.[6] ..... D21F 3/06

[52] U.S. Cl. ..... 162/205; 162/206; 162/358.3; 162/360.3

[58] Field of Search ..... 162/358.3, 358.5, 162/360.2, 360.3, 205, 206

[56] References Cited

U.S. PATENT DOCUMENTS

| | | | |
|---|---|---|---|
| 3,861,996 | 1/1975 | Dorfel | 162/360.3 |
| 4,209,361 | 6/1980 | Kankaanpaa | 162/360.1 |
| 4,483,745 | 11/1984 | Wicks et al. | 162/205 |
| 4,556,454 | 12/1985 | Dahl et al. | 162/358.3 |
| 4,561,939 | 12/1985 | Justus | 162/360.1 |
| 4,576,682 | 3/1986 | Laapotti | 162/358.3 |
| 4,662,992 | 5/1987 | Mirsberger | 162/358.3 |
| 4,704,192 | 11/1987 | Cronin | 162/358.3 |
| 4,792,381 | 12/1988 | Pajula | 162/360.1 |
| 4,909,905 | 3/1990 | Ilmarinen et al. | 162/360.1 |
| 4,915,790 | 4/1990 | Dahl | 162/358.3 |
| 4,919,762 | 4/1990 | Laapotti et al. | 162/360.1 |
| 4,931,143 | 6/1990 | Karvinen et al. | 162/360.2 |
| 4,976,820 | 12/1990 | Laapotti | 162/206 |
| 4,976,821 | 12/1990 | Laapotti | 162/360.1 |
| 5,043,046 | 8/1991 | Laapotti | 162/358.3 |
| 5,071,513 | 12/1991 | Bluhm, et al. | 162/358.5 |
| 5,120,400 | 6/1992 | Laapolti | 162/360.3 |

FOREIGN PATENT DOCUMENTS

| | | | |
|---|---|---|---|
| 0267186 | 7/1990 | European Pat. Off. . | |
| 85997 | 12/1988 | Finland . | |
| 905798 | 5/1992 | Finland . | |
| 4102356 | 1/1992 | Germany . | |
| 949449 | 2/1964 | United Kingdom | 162/360.3 |
| 8706634 | 11/1987 | WIPO . | |
| 9112370 | 8/1991 | WIPO . | |

*Primary Examiner*—Karen M. Hastings
*Attorney, Agent, or Firm*—Steinberg, Raskin & Davidson, P.C.

[57] ABSTRACT

A press section of a paper machine, in particular for printing paper qualities whose grammage is in the range of about 40 g/m$^2$ to about 80 g/m$^2$ is disclosed. The press section comprises a pick-up roll having a suction zone on which a paper web is detached at a pick-up point from a forming wire and is passed on the pick-up felt into a first press nip in the press section. In the first press nip, the pick-up felt acts as a press fabric. The press section further includes an extended nip placed after the first press nip. Into this extended nip, the web is passed as a closed draw on support of a fabric face or roll face. The first nip in the press section is a roll nip with relatively low load and acts as a front nip. In the area of the first press nip, almost or approximately one half of the total amount of the water contained in the web entering into the front nip is removed from the web. The extended nip, which is the second press nip in the press section, is formed against a smooth-faced back-up roll. Only one water-receiving press fabric passes through the press zone of the extended nip. The fabric is arranged preferably at the side of the face of the web opposite to the web face placed at the side of the forming wire from which the web is detached at the pick-up point.

15 Claims, 5 Drawing Sheets

PRESS SECTION OF A PAPER MACHINE, IN PARTICULAR FOR PRINTING PAPER QUALITIES

This application is a continuation-in-part of U.S. patent application Ser. No. 08/299,566 filed Sep. 1, 1994 now U.S. Pat. No. 5,522,959, which in turn is a divisional of U.S. patent application Ser. No. 07/995,053 filed Dec. 22, 1992 (now abandoned).

FIELD OF THE INVENTION

The present invention relates to a press section of a paper machine, in particular a paper machine for printing paper qualities whose grammage is in the range of about 40 g/m$^2$ to about 80 g/m$^2$. The press section of the present invention comprises a pick-up roll having a suction zone over which the web is detached from a forming wire at a pick-up point in the suction zone and passed onto a pick-up felt which carries the web into a first press nip in the press section. In the first press nip, the pick-up felt acts as a press fabric. The press section further includes an extended nip arranged after the first press nip in the running direction of the web. The web is passed into the extended nip as a closed draw on support of a fabric face or roll face.

The present invention also relates to a press section of a paper machine, in particular a paper machine for printing paper qualities whose grammage is in the range of about 40 g/m$^2$ to about 80 g/m$^2$. The press section comprises a pick-up roll having a suction zone over which the web is detached from a forming wire at the pick-up point in the suction zone and passed on a pick-up felt into the first press nip in the press section. The pick-up felt acts as a press fabric in the first press nip. After the first press nip, the web is transferred as a closed draw or an open draw onto a drying wire of a drying section which follows the press section in the running direction of the web. In an alternative embodiment of the press section of the present invention, the web is transferred into an additional nip which comprises a roll nip.

The invention also relates to a method for dewatering a web in a press section of a paper machine and producing paper in particular print paper whose grammage is in the range of about 40 g/m$^2$ to about 80 g/m$^2$.

BACKGROUND OF THE INVENTION

An important quality requirement of paper and board qualities is the homogeneity of the structure both on a micro scale and macro scale. The structure of the paper produced by the press section must also be symmetric, particularly for paper used in printing applications. Advantageous printing qualities required in printing paper indicate good smoothness, evenness, and certain absorption properties of both faces of the paper.

The properties of paper produced in a paper machine, in particular the symmetry of density, are affected to a considerable extent by the operation of the press section of the paper machine. The symmetric density also has substantial significance with respect to the evenness of the transverse profiles of the paper and the profiles of the paper in the machine direction.

Increased running speeds of modern paper machines create new problems to be solved, most of which relate to the running quality of the machine. At the present time, running speeds of up to about 1400 m/min are used in these modern paper machines. At these running speeds, so-called closed press sections, which typically comprise a compact combination of press rolls arranged around a smooth-faced center roll, usually operate satisfactorily. Examples of such press sections include the applicant's Sym-Press II™ and Sym-Press O™ press sections.

A particular area of papermaking technology that requires development, in order that the problems associated with the increased running speeds be alleviated, is the center roll of the compact press sections and its material which has commonly been rock. Since rock is a natural material, center rolls made of rock have certain drawbacks such as a tendency to crack caused in part by the nonhomogeneous structure of a rock roll.

In a press section, dewatering a web in a paper machine by means of pressing is preferable to dewatering by evaporation and is economical in terms of energy consumption. For this reason, it is advantageous to remove a maximum proportion of water out of a paper web by pressing in order that the proportion of water that must be removed by evaporation can be made as low as possible. However, the increased running speeds of paper machines provide new, and as yet unsolved, problems expressly in the dewatering of the web by the pressing method. For instance, the press impulse provided in the pressing method cannot be increased sufficiently by the means known in prior art. Furthermore, at high running speeds of the paper machine, the nip times remain unduly short so that the peak compression pressure cannot be increased beyond a certain limit without destroying the structure of the web.

When running speeds of paper machines are increased, the problems of running quality of paper machines are also manifested with increased emphasis because a watery web of low strength cannot withstand an excessively high and sudden impulse of compression pressure or the dynamic forces produced by high speeds. Moreover, web breaks and other disturbance in the operation of the paper machine are produced with resulting standstills. With a modern printing paper machine, the cost of a break standstill is at present about 40,000 FIM, about $8,000, per hour.

Further drawbacks of prior art press sections include the requirement of providing suction energy in the suction rolls as well as the noise problems arising from the suction rolls. Also, suction rolls with perforated mantles, interior suction boxes, and other suction systems are expensive components and require repeated maintenance and servicing.

Additional problems which are manifested with greater frequency at high running speeds of paper machines, and for which a satisfactory solution has not yet been found, include the quality problems related to the requirements of evenness of the longitudinal and transverse property profiles of the paper web. The evenness of the web that is produced in the press section also affects the running quality of the whole paper machine. The evenness of the web is also an important quality factor of finished paper, which is important in respect of copying and printing papers where the requirements of the speeds of copying and printing machines, and uniformity of the printing result, are increased.

The property profiles of the paper produced in the machine direction are also significantly affected by oscillations of the press section and the transverse variations of properties by the transverse profiles of the nip pressures in the press nips. With increasing running speeds of the paper making machine, these profile problems tend to be remarkably increased.

With respect to the prior art related to the present invention, reference is made to Finnish Patent Application Nos. FI 842114 (corresponding to U.S. Pat. No. 4,976,821), FI 842115 (corresponding to U.S. Pat. No. 4,931,143), FI 850627 (corresponding to U.S. Pat. No. 4,561,939), FI 875715 (corresponding to WO 87/06634) and FI 905798, to published Finnish Patent Nos. FI 78,941 (corresponding to U.S. Pat. No. 4,976,820) and FI 80,094 (corresponding to U.S. Pat. No. 4,483,745), and to European Patent No. EP 0 267 186. An object of the present invention is further development and improvement of the prior art press section known from the publications mentioned above.

In published Finnish Patent Application No. FI 909798 (U.S. patent application Ser. No. 07/795,043 now U.S. Pat. No. 5,389,205), a method is described which comprises a combination of the following steps: transferring a paper web from a forming wire onto a wire in a drying section while constantly supporting the web by means of a fabric that receives water, a transfer fabric, or another corresponding transfer surface as a closed draw, preferably at a speed that is higher than about 25 to about 30 m/s; dewatering the paper web by means of at least two subsequent press nips, at least one of which is a so-called extended-nip zone whose length in the machine direction is larger than z>about 100 mm, and forming the extended-nip zone in connection with a mobile flexible press-band loop; and regulating the distribution of the compression pressure employed within the extended-nip press zone both in the transverse direction of the web and in the machine direction so as to set or control the different profiles of properties of the web.

It is an important feature of the method and the device of the above mentioned Finnish Patent Application No. FI 905798 that the paper web is not passed through the press section on one press fabric, but, to guarantee an adequate dewatering capacity, an arrangement of fabrics is employed in which the web is transferred from the pick-up point on the first upper fabric to the drying wire on several fabrics. First, the web is transferred in the first press zone from the first upper fabric to a first lower fabric which runs through the first press zone. The first press zone is preferably an extended-nip zone. The web is thereafter transferred from the first lower fabric onto a second upper fabric which carries the web into a second nip zone. The second nip zone consists of a roll nip, or preferably an extended-nip zone. In the second nip zone, the web is transferred onto a second lower fabric which runs through the second nip zone and carries the web on its upper face as a closed draw onto the drying wire or into an additional nip zone.

The principal dewatering methods in known wire sections described in the above-mentioned documents utilize common dewatering devices, e.g., centrifugal force, foil phenomena, pressing between two wires against a curved shoe, etc. A dry solids content in the range of about 12% to about 20% can be achieved by these methods whereby the pressure applied to the web in the "dewatering points" is fractions of 1 bar. After the wire section, the web still contains plenty of water which is readily removed by methods that are more efficient than those mentioned above. Of the methods mentioned above, the only method based on mechanical pressing is the use of a curved shoe in combination with the tension of a wire in which case the pressure level in a nip is in the order of less than 0.1 bar. However, it is a disadvantage that if such a dewatering step were to be followed by a high-pressure dewatering method, such as an extended nip, there would be a large leap in the pressure applied to dewater the web.

OBJECTS AND SUMMARY OF THE INVENTION

An object of the present invention is further development and improvement of the prior art press sections so that a press section in accordance with the present invention is suitable for printing paper qualities with a grammage above the range of the prior art press sections and in the range of abut 40 g/m$^2$ to about 80 g/m$^2$. These paper qualities also include papers for copying machines whose use is abundant at the present time.

Another object of the present invention is to provide a press section in which it is more efficient to utilize the high dewatering capacity of prior art extended nips in combination with the capability of the extended nips, under certain conditions, to provide a high dry solids content of the web.

It is yet another object of the invention to provide a press section in which a certain kind of front nip with a light loading is employed so that an extended nip following the front nip in the running direction of the web operates in a preferred range of dry solids content. The front nip also substantially reduces the water load of the extended nip in order to achieve a sufficiently high dry solids content of the web.

It is still another object of the present invention to provide a press section in which, in the case of modernizations of existing press sections, the front nip can be combined with existing components or with other components that are necessarily needed, so that the construction of the press section of the present invention becomes relatively simply and economical. In this regard, an object of the invention is to provide a press section in which it is possible to employ a relatively low linear load in the front nip which permits simple and inexpensive components to be used.

In view of achieving the objects stated above and those that will come out later, the present invention comprises a press section in which the first nip is a roll nip having a relatively low load. The first press nip is arranged to act as a front nip in whose press zone approximately one half of the total amount of the water contained in the web entering into the front nip is removed from the web. An extended nip is the second press nip in the press section and is arranged against a smooth-faced back-up roll. Only one press fabric, which substantially receives water, passes through the press zone of the extended nip.

It is an advantage of this structure that the removal of a substantial amount of water from the web in the first press nip is significantly advantageous because it prevents a large "leap" or "jump" in the pressures applied to dewater the web. This leap arises when the web is first dewatered, e.g., by means of a press shoe or other low pressure dewatering device wherein the pressure applied to dewater the web is generally less than about 0.1 bar, and then carried into an extended nip without any intervening dewatering stages. Herein, the arrangement of the first press nip, wherein the pressure level is, e.g., about 10 bar to about 20 bar (1000 kPa to 2000 kPa), before the extended nip operates to remove a large amount of water from the web thereby constituting an intermediate dewatering pressure stage before the extended nip, wherein the pressure level is over about 3000 kPa. This provides a more efficient dewatering of the web so that the web has a preferred dry solids content for the extended nip to operate advantageously.

Moreover, another advantage of the above structure is that it is possible to add an additional press nip into the press section by placing only a single additional roll against an existing smooth-faced press roll forming an extended nip which is already included in the press section. Advantages of this arrangement include the fact that no separate frames need to be constructed to form this additional nip, the nip occupies little space and a single additional roll and one additional press felt are required. The additional nip is formed against the pick-up roll, the center roll or a wire guide roll, all of which normally exist in a press section.

In another embodiment of the present invention, the press section is preceded by a wire nip which substantially dewaters the web. The wire nip is formed between a press roll placed inside the loop of the forming wire and a hollow-faced press roll, or hose roll, provided with an extended-nip zone or equivalent that operates opposite to the press roll. A relatively open press fabric is passed through the wire nip.

In certain embodiments of the present invention, there is one front nip with relatively light loading before the extended-nip press. By means of the front nip, a substantial volume of water can be removed from the web, so that the overall water quantity in the web can be reduced to about one half. In such a case, if the distribution of the nip pressure in the machine direction of the extended nip applied in the invention is adjusted to be suitable for the purpose of dewatering the web, the extended nip can be made to operate particularly favorably and increase the dry solids content of the web to a sufficiently high level.

In a preferred embodiment, the extended-nip press is a single-felt nip and constitutes the only press nip formed against the smooth-faced center roll. Moreover, the pick-up felt constitutes the only water-receiving press fabric in the extended nip. The web is separated from the smooth-face center roll after, or in the vicinity of, the extended nip such that the first press nip and the extended nip constitute the only press nips through which the web is passed in its run from the forming wire to its separation from the smooth-faced center roll. However, even though the web passes through only two nips from the pick-up point, by regulating the loading of the first press nip and the loading of the extended nip, it can be assured that the dry solids content of the web is sufficient to enable the web to be passed in the open draw, e.g., from about 48% to about 54%, and directed for further processing, e.g., to the dryer section. The press felt and the pick-up felt would then be the only felts in contact with the web during its run from the forming wire to detachment from the smooth-faced press roll. Other felts and/or press nips would not be required resulting in substantial savings in terms of dewatering equipment acting on the web in the forming section. Indeed, since the first press nip (front nip) is formed by placing only a single additional roll against the pick-up roll, the center roll or a wire guide roll, all of which normally exist in a press section, it is possible to realize a significant gain in dewatering potential without an unduly large equipment cost.

A third press nip can be employed in certain embodiments of the press section of the invention. The primary purpose of the third nip is to improve the symmetry of the web in the direction z. The third nip is preferably a single-felt hard roll nip whose dewatering direction is opposite to the dewatering direction in the preceding extended nip. When the web is formed by means of a hybrid or single-wire former, the dewatering takes place in the extended nip through the upper face of the web, i.e., through the face that is placed facing away from the only forming wire or the lower wire, in order to obtain a symmetry of fines and fillers in the direction z in the web.

In another preferred embodiment, the first press nip constitutes the only press nip through which the pick-up felt runs and only one water-receiving press fabric passes through the extended nip press zone. In this embodiment, the first press nip is formed by a suction roll and a first smooth-faced press roll which receives the web from the pick-up roll while carried by the pick-up felt. The web is carried on the face of the first smooth-faced press roll to be passed as a closed draw into the extended nip. An additional press nip is formed in part by a second smooth-faced press roll and is arranged after the extended nip in the running direction of the web. It is an important feature that the second smooth-faced press roll is arranged in relation to the first smooth-faced press roll such that an open draw of the web is defined at one end by the first smooth-faced press roll and at an opposed end by the second smooth-faced press roll such that the web is passed directly into the additional press nip from the extended nip. The side of the web that contacts the second smooth-faced press roll is opposite from the side of the web that contacts the first smooth-faced press roll so that dewatering in the additional press nip occurs in an opposite direction to the direction of dewatering in the extended nip. Preferably, the first press nip and the extended nip constitute the only press nips through which the web is passed in its run from the forming wire to the open draw.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
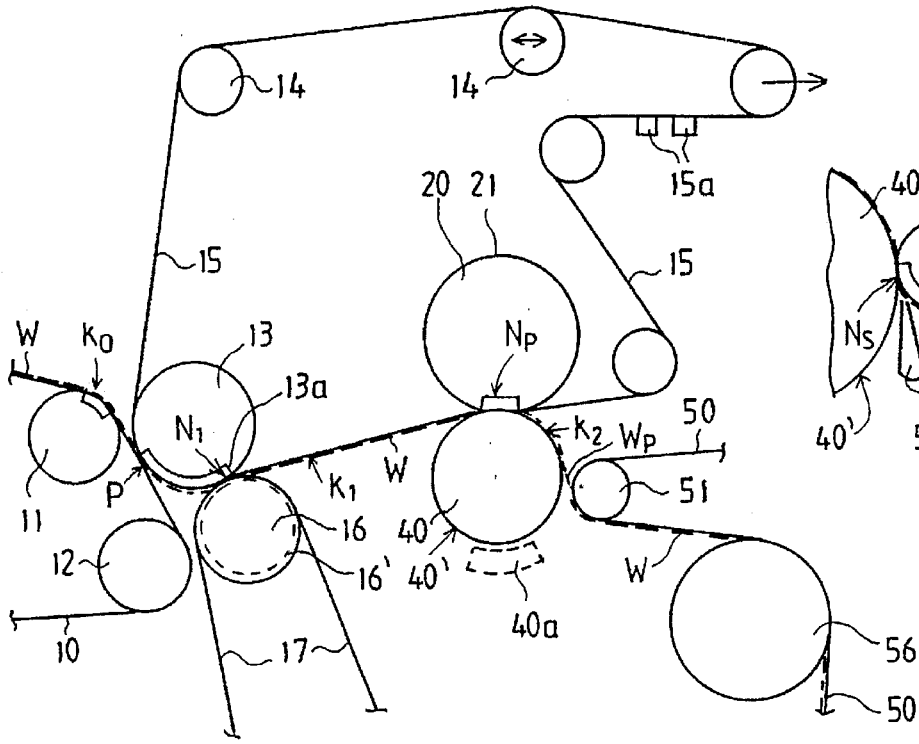
FIG. 1 shows a first embodiment of a press section in accordance with the present invention in which a pick-up press is used as the first roll nip, i.e. the front nip.

According to FIG. 1, a paper web W, which has been formed on a forming wire 10, is separated at a pick-up point P from the forming wire 10 on a run of the forming wire between rolls 11 and 12 in the web former. From the pick-up point P, the web W is transferred onto the pick-up felt 15, aided by suction zone 13*a* of the pick-up roll 13. Pick-up felt 15 is guided by guide rolls 14 and conditioned by devices, or other conditioning means, 15*a*. A dewatering front nip $N_1$ is provided in connection with suction zone 13*a* of the pick-up roll 13. The front nip $N_1$ is preferably a roll nip.

A lower roll in the front nip $N_1$ is a hollow-faced 16' press roll 16 around which a lower press felt 17 runs. In this manner, the first roll nip $N_1$ is provided with two felts 15, 17 between which the webs run. A variable-crown roll is usually not used in the front nip $N_1$, and if used, the loading shoe of the variable-crown roll is not directed against the front nip.

In the present invention, the front nip $N_1$ is a press nip with relatively light loading and in which about one half of the overall dewatering in the press section takes place. By means of the press nip $N_1$, the dry solids content in the web W is raised, e.g., to 20 to 30 percent. With regard to the construction of press nip $N_1$, the construction shown in FIG. 1 is preferable because the pick-up roll 13 and the pick-up felt 15 can also be used as a press roll and press felt, in addition to the usual functions of these elements. This is possible because of the low load in the nip $N_1$. The linear load in the nip $N_1$ is generally in the range of about 10 kN/m to about 120 kN/m, preferably in the range of about 30 kN/m to about 80 kN/m. The maximum pressure in the nip $N_1$ is from about 2 bar to about 20 bar.

Referring to FIG. 1, as a result of the adhesion properties of the upper felt 15 and/or the negative pressure in the suction zone 13*a*, after the front nip $N_1$, the web W follows the upper felt 15 and is transferred on the lower face of upper felt 15 into the extended-nip press. The web W runs through the press zone NP in the extended nip Np of the press section. The extended nip Np is formed between an upper "hose roll" 20, which will be described in more detail later, and a lower smooth-faced 40' press roll 40. The extended nip Np is preferably a nip provided with one press fabric 15 and formed against a smooth-faced lower roll.

In other embodiments, wherein the web W is formed by means of a hybrid former or a Fourdrinier wire part, the dewatering direction in the extended nip Np is through a face of the web W that is placed facing away from the face of the web that is at the side of the forming wire 10, i.e., preferably through the upper face of the web when the lower face of the web contacts the forming wire.

Figure 5:
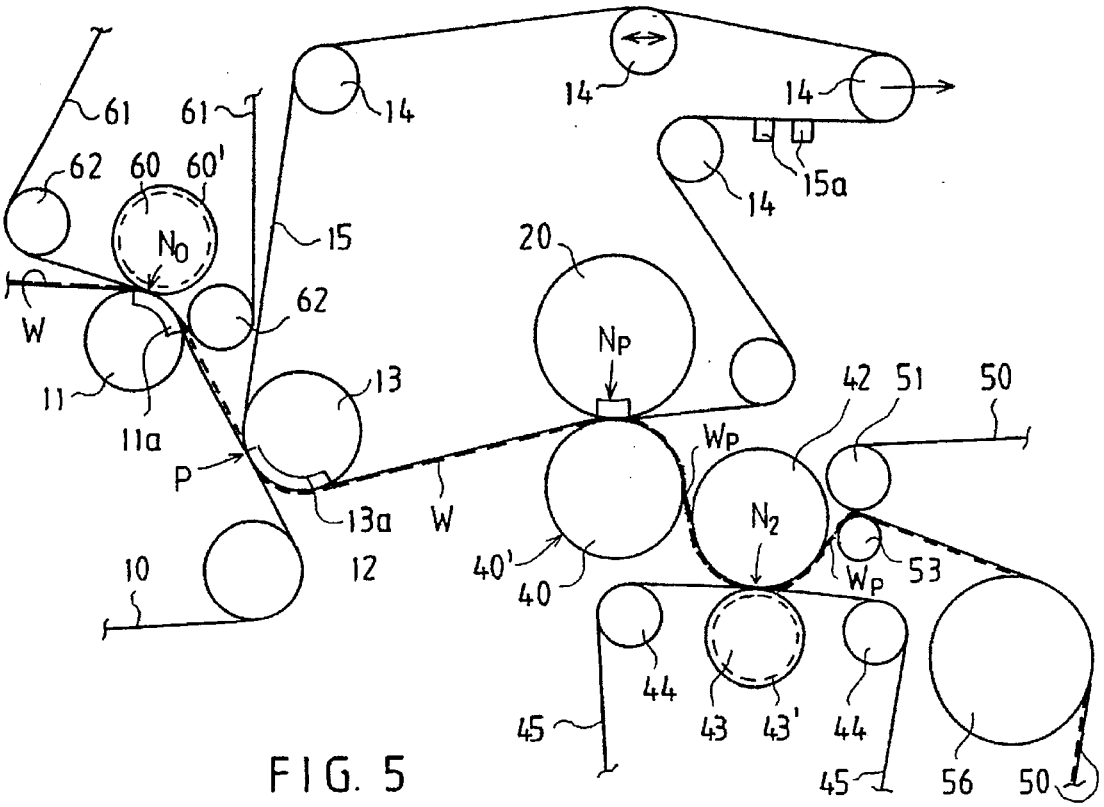
FIG. 5 shows a variation of the press section of the present invention in which the front nip is a roll nip placed in connection with a forming wire.
Figure 6:
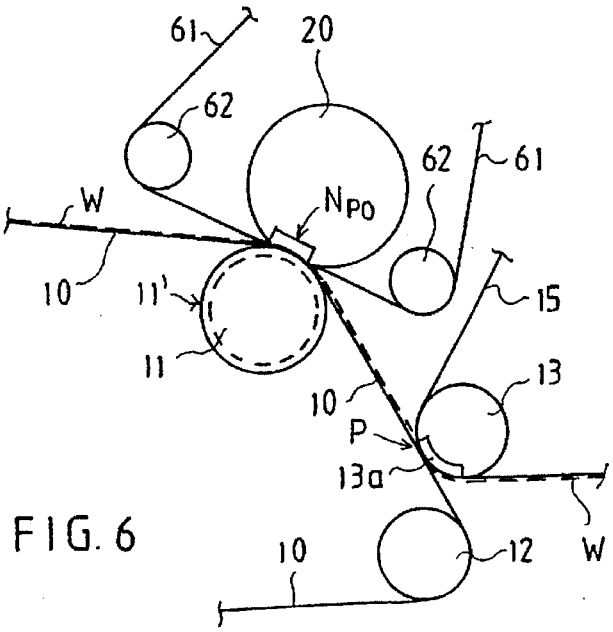
FIG. 6 shows a variation of the embodiment of the invention shown in FIG. 5, wherein an extended nip is placed on the forming wire and is used as the front nip instead of the roll nip.

According to the present invention, when a front nip with a light loading is utilized in the press section before the extended nip Np, a considerable volume of water can be drained by means of the front nip even with the relatively low load. The front nip may also comprise a wire nip $N_0$ or $Np_0$, as shown in FIGS. 5 and 6 and described in more detail later. Generally, about one half of the amount of water in the web that enters into the front nip is drained by means of the front nip. In such a case, the water load that enters into the extended nip can be reduced considerably so that the extended nip operates in a favorable range of dry solids content. Furthermore, a sufficiently high dry solids content of the web can be accomplished by means of the extended nip wherein the maximum load is about 10 to about 30 times the maximum load of the front nip and the maximum pressure is about 5 to about 50 times the maximum pressure of the front nip. The extended nip may also be based on a press shoe in this embodiment.

In the following, an example is provided of quantities of water that have been calculated for a fine paper having a grammage of about 45 g/m$^2$; if the dry solids content of the paper web after the wire part is about 20%, the amount of water contained in the paper is about 180 g/m$^2$. As the dry solids content can be raised by about 10 percentage units, i.e. to about 30%, by utilizing the front nip $N_1$,$N_0$,$Np_0$ with relatively light load, the amount of water in the web is about 105 g/m$^2$. Therefore, by means of the front nip, the overall water quantity in the web W can be lowered almost to one half of the water quantity before the front nip.

The lower sector of the lower roll 40 in the extended nip Np may be provided with heating devices, for example infrared heaters 40*a*. By means of the heating devices 40*a*, the temperature level and/or the transverse temperature profile of the lower press roll 40 is/are regulated so as to intensify the dewatering in the extended nip Np and/or to control the separation of the web W from the full face 40' of the lower roll 40 after the extended nip Np.

After the extended nip Np, the web W is separated from the upper felt 15 and follows the smooth face 40' of the lower roll 40. The web is detached from the lower roll 40 as a short open draw Wp and transferred onto a drying wire 50. The drying wire 50 is guided by guide roll 51 and runs meandering over the drying cylinders. In FIG. 1, only a first upper cylinder 56 in the drying section is shown.

Figure 1A:
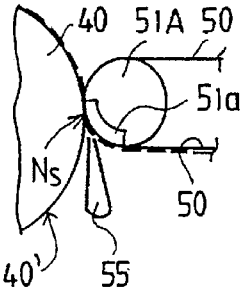
FIG. 1A shows an alternative closed draw from a lower roll of an extended nip in a press section in accordance with the present invention.

FIG. 1A shows an alternative embodiment in the transfer of the web W from the smooth face 40' of the lower roll 40. A transfer-suction roll 51A is used to transfer the web W. Transfer-suction roll 51A forms a transfer nip Ns with the lower roll 40 of the extended nip Np. Underneath the transfer nip Ns, a blower device 55 is arranged to aid in the separation of the web W from the roll face 40' and the transfer of the web onto the drying wire 50. Negative pressure in the suction zone 51*a* of the transfer-suction roll 51A also assists in the separation and transfer of the web.

The length Z of the extended nip Np in the machine direction is preferably in the range of from about 150 mm to about 250 mm, so that the length Z is at least greater than about 100 mm. In this manner, the dry solids content of the web W in the press section is favorably as follows. When the dry solids content $k_0$ on the forming wire at the pick-up point P is $k_0$ is about 20%, the dry solids content $k_1$ after the first roll nip, i.e. the front nip $N_1$, is from about 25% to about 33%, an increase of 5%–15%. The dry solids content $k_2$ of the web W after the extended nip Np is from about 48% to about 54%.

In certain embodiments of the press section in accordance with the invention, the lower roll 40 in the extended nip Np is a variable-crown smooth-faced 40' roll, e.g. the applicant's Z-roll™, whose coating is arranged to transfer the web W, such as Dynarock™.

Figure 2:
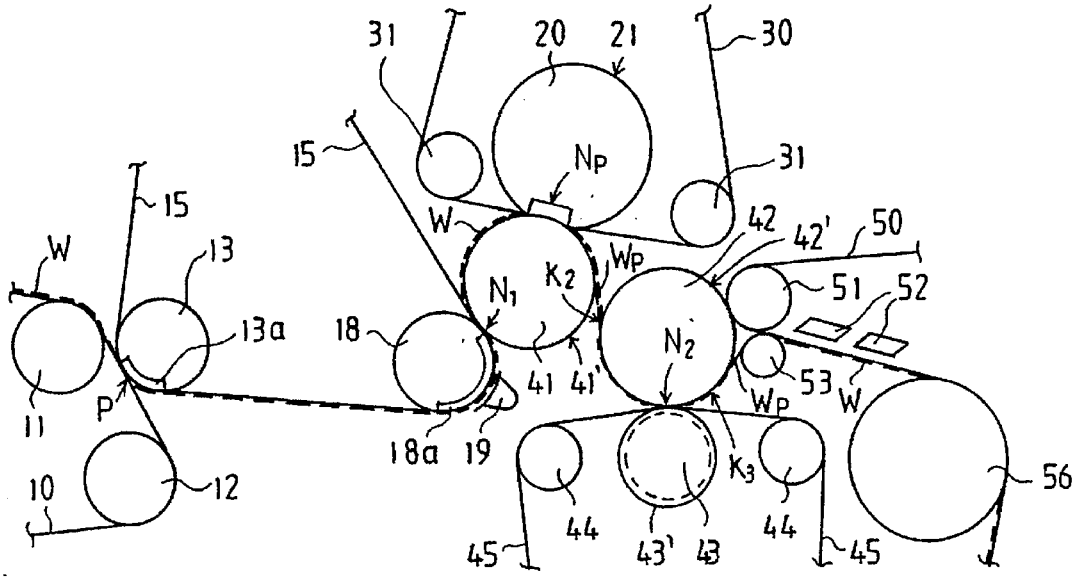
FIG. 2 shows an embodiment of a press section of the present invention in which a first roll nip, i.e. the front nip, is formed in connection with a smooth-faced lower roll of an extended nip.

In a press section as shown in FIG. 2, a first front nip $N_1$ with light loading is formed between a press-suction roll 18, also referred to as a reversing roll, and a smooth-faced 41' center roll 41. The center roll 41 also functions as the lower roll of the extended nip Np. The web W is brought on pick-up felt 15 over suction zone 18*a* of the lower press roll 18 into the first roll nip $N_1$. A steam box is arranged on suction zone 18*a*. In the first roll nip $N_1$, the pick-up felt 15 acts as a press felt.

After the nip $N_1$, the web W follows the smooth face 41' of the center roll 41 and is carried into an extended nip Np. The extended nip Np is formed by the center roll 41 and an upper hose roll 20. Through the extended nip Np, one water-receiving press felt 30 runs guided by guide rolls 31. After the extended nip Np, the web W follows the smooth face 41' of the roll 41, The web is detached from roll 41 as a short free draw Wp and is transferred onto a smooth face 42' of an upper roll 42 of a second roll nip $N_2$. The web is passed into the second nip $N_2$ on smooth face 42'.

In FIG. 2, the lower roll of the second roll nip $N_2$ is a press roll 43 provided with an open hollow face 43' and a lower felt 45. Lower felt 45 is guided by guide rolls 44 and runs through the second roll nip $N_2$. After the second roll nip $N_2$, the web W follows the smooth face 42' of the upper roll 42. The web is separated from the upper roll 42 as a short free draw Wp and is transferred on a paper guide roll 53 onto a drying wire 50. The web W remains on the lower face of the drying wire 50 by means of a field of negative pressure produced by boxes 52.

A third nip in the press section, i.e. the second roll nip $N_2$, is provided in certain embodiments to promote the symmetry in the web in the direction z by removing a small amount of water through the lower face of the web W. By removing water through the second roll nip, water fillers and fines are washed towards the lower face of the web W, i.e. in the direction opposite to the removal of water in the extended nip Np. As a result of the placement of the third nip in the press section, the symmetry in the web is improved. For example, if the dry solids content $k_2$ of the web after the extended nip Np is from about 48% to about 54%, preferably $k_2$ is about 52%, the dry solids content $k_3$ of the web W after the third press nip in the press section, i.e. after the second roll nip $N_2$, is from about 52% to about 56%, preferably $k_3$ is about 54%.

Figure 3:
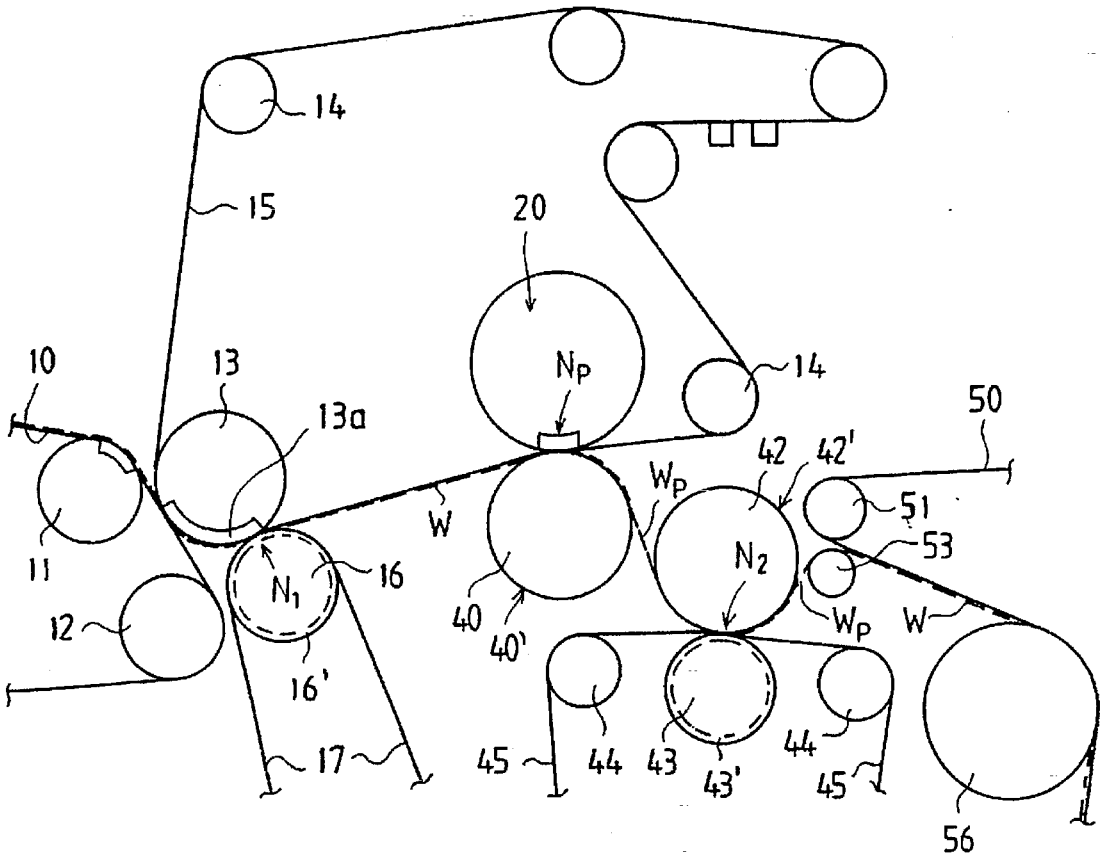
FIG. 3 shows a variation of the embodiment of the press section of the present invention shown in FIG. 1 in which a roll nip comprises the last nip arranged after an extended nip which provides for an improvement in the symmetry of the web in the direction z.

FIG. 3 shows a variation of the press section as shown in FIG. 1 in which a second roll nip $N_2$, similar to that described above in relation to FIG. 2, is utilized for the purpose described above, i.e. better symmetry of the web. The construction of the press section in FIG. 3 is in the other respects similar to that described in FIG. 1 and, with respect to the second roll nip $N_2$ and to the development of the dry solids contents, similar to that described above in relation to FIGS. 1 and 2.

Figure 4:
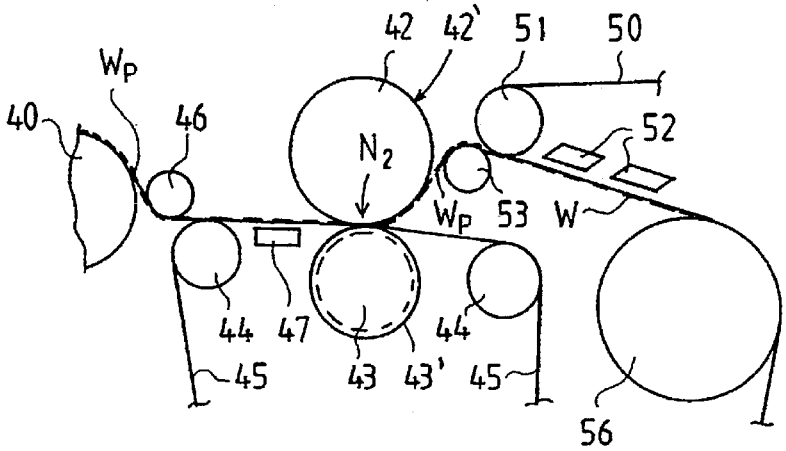
FIG. 4 shows an alternative draw of the web into the last roll nip in the press section in accordance with the invention as shown in FIG. 3.

FIG. 4 shows a variation in the area of the second roll nip $N_2$ in a press section in accordance with the present invention, while the rest of the construction is similar to that shown in FIG. 3. According to FIG. 4, the web W is separated as a short free draw Wp from the smooth face 41' of the lower roll 40 in the extended nip Np. The web is then transferred in the short free draw Wp and guided by paper guide roll 46 onto the lower felt 45 of the second roll nip $N_2$ at the level of its first guide roll 44. After guide roll 44, a suction box 47 is arranged inside the loop of the lower felt 45. By means of the suction box 47, the web W will remain on the lower felt 45 as it is transferred into the second roll nip and from the second roll nip $N_2$ further in the manner described above in relation to FIG. 3.

FIG. 5 shows a variation of the invention that is in most respects similar to the embodiment of the invention shown in FIG. 3, except that a wire nip $N_0$ replaces the first roll nip, i.e., the front nip $N_1$. According to FIG. 5, the wire nip $N_0$ is formed between a suction zone 11*a* of a lower suction roll 11 placed inside the loop of the forming wire 10 and an upper press roll 60 provided with an open hollow face 60'. A relatively open and permeable press fabric 61 is guided by guide rolls 62 and runs through the wire nip $N_0$.

In the wire nip $N_0$, a relatively low linear load is preferably used which is of an order of about 10 kN/m to about 40 kN/m so that the relatively weak structure of the just formed and substantially wet web W is not destroyed. In the wire nip $N_0$, the dry solids content of the web is raised, e.g., from about 18% to about 22%. In the other respects, the press section construction shown in FIG. 5 is similar to that described above in relation to FIG. 3.

FIG. 6 shows a variation of the wire nip applied in the press section illustrated in FIG. 5. According to FIG. 6, the wire nip is an extended nip $Np_0$ through which a substantially pervious press fabric 61 runs. Press fabric 61 is guided by guide rolls 62. The upper roll in the extended nip $Np_0$ is a hose roll 20, and the lower roll is a press roll 11 whose face 11' is to some extent water-receiving. The length of the extended nip $Np_0$ in the machine direction is quite large, generally between about 250 mm to about 400 mm. The distribution of the pressure compression in the machine direction is preferably uniform, for example within the range of about 1 bar to about 15 bar. In the other respects, the press section construction shown in FIG. 6 is similar to FIGS. 3 and 5 described above.

Figure 7:
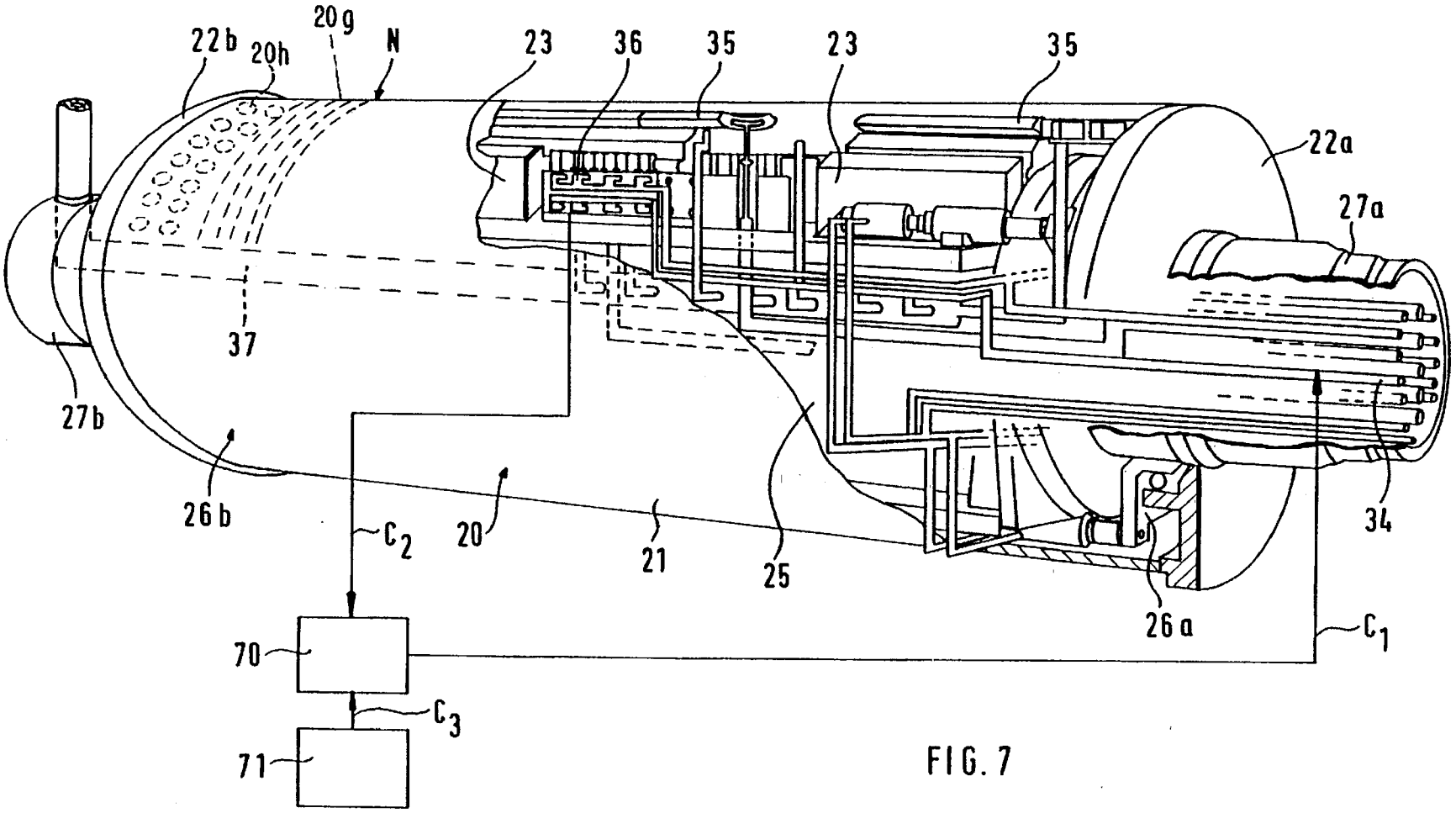
FIG. 7 is a partial axonometric view of a section of a hose roll used as the upper roll in an extended nip in a press section in accordance with the invention.
Figure 8:
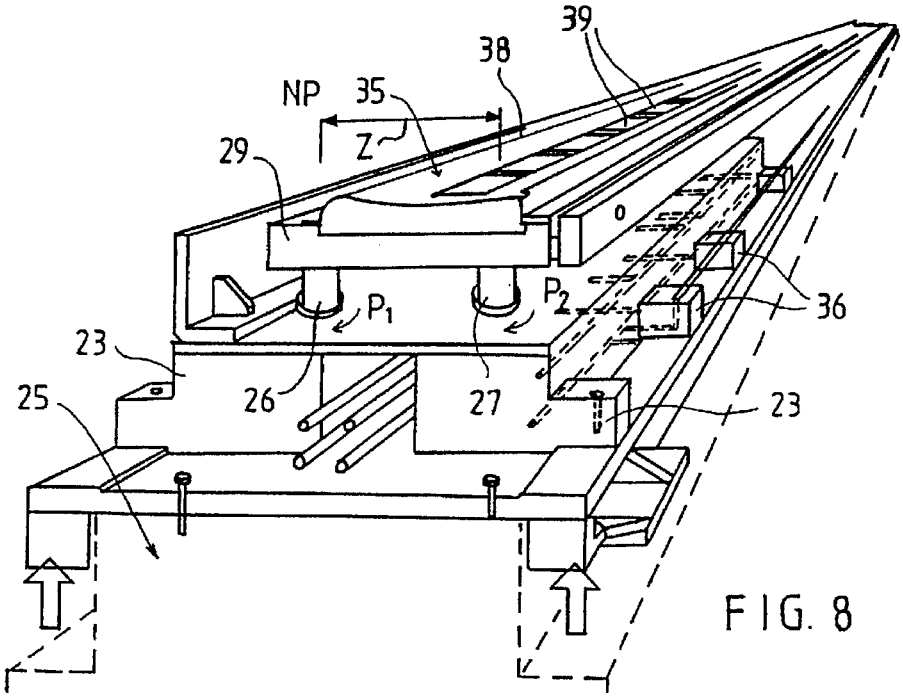
FIG. 8 is an axonometric view of a press shoe placed inside the hose roll in the press section as shown in FIG. 7 and which can be loaded and profiled in different ways.
Figure 9:
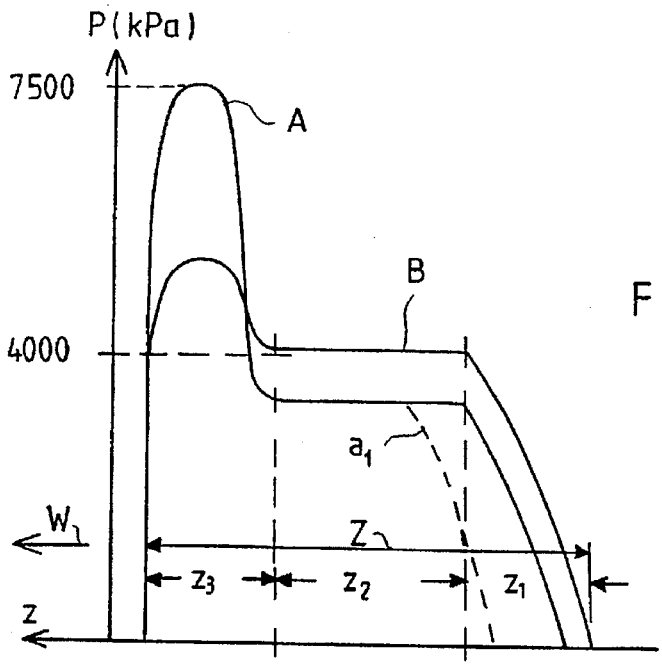
FIG. 9 illustrates advantageous distributions of compression pressures in the machine direction of an extended nip applied in a press section in accordance with the present invention.

Referring to FIGS. 7, 8 and 9, an advantageous hose roll 20 is illustrated which can be used in an extended nip Np or wire nip $Np_0$ in the press section in accordance with the present invention.

In FIG. 7, a hose roll 20 comprises an elastic mantle 21 which is constructed, e.g., from fabric-reinforced polyurethane, so that the hose mantle 21 comprises a rubber-like stretching material whose maximum elongation is about 1% to about 2%. The thickness of the hose mantle 21 is in the range of about 2 mm to about 5 mm. The outer face of the hose mantle 21 is generally smooth, but in particular cases it may also be a hollow-faced roll that receives water. The term "hollow-faced press roll" as used in this application refers to a blind-drilled roll as well as a roll having a grooved face. The outer face of hose mantle 21 of hose roll 20 is provided with its hollow-face, e.g., by means of grooves 20*g* and/or blind-drilled holes 20*h* shown in phantom lines in FIG. 7, so that it can receive water through the grooves or holes.

Annular ends 22*a* and 22*b* are fixed permanently to the hose mantle 21. Inner parts of ends 22*a*, 22*b* are fixed and sealed against revolving axle journals 27*a* and 27*b* mounted on frame parts of the paper machine by means of fixed bearing supports. Hose roll 20 includes a stationary inner frame 25 around which the hose mantle 21, and ends 22*a*, 22*b*, revolves on bearings 26*a* and 26*b*.

As shown in FIG. 8, two sets of cylinder blocks 23 are placed side by side and arranged in the inner frame 25. Hydraulic support members 26, 27 of a glide shoe 35 operate in bores placed in the two sets of cylinder blocks 23. Support members 26, 27 are placed in two rows, e.g., with a spacing of about 25 cm, in the transverse direction one after the other. The two rows of the hydraulic support members 26, 27 support a support plate 29, to which a glide shoe 35, e.g., made of aluminum, is attached. In the area of the glide shoe 35, an extended nip zone Np is formed against a backup roll 40, 41.

Glide shoe 35 is provided with a smooth glide face 38 which operates as a press member against the lubricated smooth inner face of the hose mantle 21. The glide shoe 35 has a series of hydrostatic chambers 39 placed one after the other. The chambers 39 contribute to the formation of a hydrostatic loading pressure and to oil lubrication of the glide face 38.

Each of the subsequent cylinder blocks 23 is arrange to contact a connector 36 to which pipes 34 pass. A loading medium flows through pipes 34 so that a separately adjustable pressure can be passed into each individual block in the series of cylinder blocks 23. In this manner, the pressure profile in an extended-nip zone Np can be regulated and controlled precisely and in a versatile way both in the machine direction and in the transverse direction.

The pressure ratio $p_2/p_1$ of the two different rows of support members 26, 27 is generally selected to be constant whereas the pressure passed into each block is freely adjustable within certain limits.

In FIG. 7, a regulation system utilized in the press section of the present invention is illustrated. The pressure profiles of the extended nip NP in the transverse direction and in the machine direction can be controlled by means of the regulation system. The regulation system is illustrated schematically by block 70, from which a series of regulation signals $c_1$ are given which regulate the hydraulic pressures fed through the pipes 213. A feedback signal is received in the regulation system 34 from separate wiring 36 which is illustrated by a series of signals $c_2$. Further, the regulation system 34 communicates with a measurement arrangement 71 arranged to measure the different profiles of the paper web W produced, such as moisture or thickness profiles. Measurement arrangement 71 provides a series of feedback signals $c_3$ for the regulation system 70, which in turn produces the series of regulation signals $c_1$.

As shown in FIG. 7, a hose roll 20 is oil-tight and the interior of the hose 21 can be constructed to be slightly pressurized. A slight leakage of oil takes place from the glide faces 38 of the glide shoes 35. This leaked oil is collected from inside the hose mantle 21 and passed through pipe 37 back to the oil circulation system.

Hose roll 20 is preferably mounted on fixed bearing supports, in which case the extended nip Np is opened by means of a movement of the lower backup roll 40, 41. This movement is usually necessary, because the play, or clearance, of about 15 mm for movement of the glide shoes 35 of the hose roll 20 is not sufficient for opening the nip Np sufficiently, e.g., for replacement of the fabrics 15, 30, 61.

FIG. 9 illustrates several pressure distributions in the extended-nip zone NP in a system of coordinates of pressure/length in the machine direction (z). The pressure distributions are advantageous in a press section in accordance with the invention. Underneath the pressure curves shown in FIG. 9, an example is given of the shape of the press shoe 35 and its glide face 38. By means of the selected shape of the press shoe 35 and glide face 38, the pressure curves A and B shown in FIG. 9 can be obtained when the press shoe 35 is loaded by adjustable forces $F_1$ and $F_2$ against a smooth-faced lower back-up roll 40, 41. In FIG. 9, the running direction of the web is parallel to the z-axis, i.e., parallel to the arrow W. Referring to the pressure curve A in FIG. 9, in the first press zone $z_1$ of the shoe 35, i.e., after the area of the front edge 38*a* of the shoe, the pressure rises in an almost linear manner to a value of about 3500 kPa. After the linear increase, the pressure remains substantially uniform in the second press zone $z_2$. The pressure in the second zone $z_2$ is determined primarily by the adjustable pressure of the pressure fluid fed through the ducts 39*a* in the shoe 38 into the hydrostatic zone 39. In the third zone, the pressure rises from the uniform pressure (in the second zone $z_2$), very steeply to a maximum pressure which is of an order of about 7500 kPa. After a maximum pressure which prevails in the middle area of the third and last zone $z_3$, the pressure is lowered to zero very sharply right before a curved rear edge 38*b* of the shoe 38.

In FIG. 9, a second pressure curve B is shown in which the pressure rises in zone $z_1$ in a substantially linear manner to the invariable pressure in the second zone $z_2$, i.e. to a pressure of about 4000 kPa. After this linear rise, the pressure rises in the third zone $z_3$ to a maximum pressure which is substantially lower than in the case of the pressure curve A. In addition, in FIG. 9, an alternative curve of pressure lowering $a_1$ is shown which is carried into effect with the shape 38*a*$_1$ of the front edge 38*a* of the glide face of the press shoe illustrated by a dashed line.

The pressure curve A represents a situation in which the ratio of the loading forces $F_1/F_2$ is at the maximum whereas curve B represents a curve that carries into effect a minimum value of the force ratio $F_1/F_2$. By means of the ratios of loading forces, it is possible to control the dewatering process by regulating the form of the pressure curve in the extended-nip zone NP as well as to maximize the dry solids content of the web W after the extended nip NP.

Figure 10:
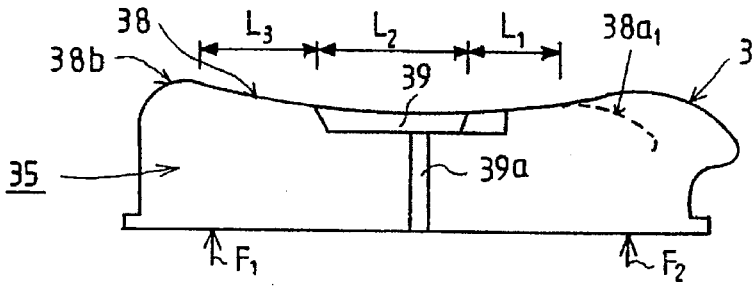
FIG. 10 is a sectional view of a preferred press shoe employed in a hose roll in the press sections shown in FIGS. 7 and 8, and by means of which the distributions of compression pressure in the machine direction, as shown in FIG. 9, can be accomplished.

Moreover, in FIG. 10, a preferred dimensioning of the different portions $L_1$, $L_2$ and $L_3$ of the glide face 38 of the press shoe is illustrated ($L_1$=about 70 mm, $L_2$=about 110 mm, $L_3$=about 70 mm).

FIG. 9 is an illustrative example of the manner in which the distribution of pressure in the extended-nip zone NP in the machine direction can be controlled to optimize the dewatering when a hose roll 20 as shown in FIG. 7 is used in accordance with the invention exactly in the specified position in the press section.

In an extended nip Np arranged in accordance with the invention, the distribution of pressure can also be controlled in the transverse direction so as to control various profiles of properties of the web W, such as the dry-solids profiles, in the transverse direction. In this manner, highly versatile possibilities are provided for the control of the dewatering and of the dewatering profiles in the machine direction and in the transverse direction.

The examples provided above are not meant to be exclusive. Many other variations of the present invention would be obvious to those skilled in the are and are contemplated to be within the scope of the appended claims.

I claim:

1. A press section of a paper machine including a plurality of press rolls and a pick-up roll provided with a suction zone on which a paper web is detached from a forming wire and transferred to a pick-up felt, comprising a first press nip formed by a pair of said plurality of press rolls directly after the web is transferred to said pick-up felt without the interposition of another press nip before said first press nip, said first press nip being loaded at a loading force between 30 kN/m and 80 kN/m, said pick-up felt carrying the web into said first press nip and acting as a press fabric in said first press nip, said first press nip constituting the only press nip through which the pick-up felt runs, extended nip means for forming an extended nip arranged after said first press nip in a running direction of the web without the interposition of another press nip between said first press nip and said extended nip, said extended nip means comprising a first smooth-faced press roll and having an extended nip press zone through which a single water-receiving press fabric passes, said extended nip being loaded at a loading force 10–30 times the loading force of said first press nip such that the dry solids content of the web is raised to a level sufficient to enable the web to be passed in an open draw, said extended nip means comprising a hose roll against which said extended pip is formed, said hose roll comprising a flexible mantle having a smooth inner face and a hydraulically loaded glide shoe arranged in said mantle, said glide shoe having a smooth glide face arranged against said smooth inner face of said mantle, said hollow-faced outer face of said mantle being adapted to receive water, and said glide shoe being loaded such that the distribution of compression pressure in said extended nip in both the machine direction and in the transverse direction is adjustable so as to optimize the dewatering taking place in said extended nip and control the profiles of properties of the web in the transverse direction, said first press nip being formed by a suction roll and said first smooth-faced press roll, said first smooth-faced press roll being structured and arranged such that the web is passed from said pick-up roll and received on the smooth face of said first smooth-faced press roll in the vicinity of said first press nip and is carried on said first smooth-faced press roll to be passed as a closed draw into said extended nip, said suction roll having a suction zone extending over a curved circumferential segment thereof and constituting a reversing roll whereby the pick-up felt runs in a first direction into engagement with said suction roll and then over said suction zone of said suction roll to cause the running direction of the pick-up felt to be reversed, the web being carried by the pick-up felt to the end of said suction zone and into said first press nip, a steam box having a curved face, said steam box being arranged in opposed relationship to at least a portion of said suction zone of said suction roll, and an additional press nip formed in part by a second smooth-faced press roll and arranged after said extended nip in the running direction of the web, said second smooth-faced press roll being arranged in relation to said first smooth-faced press roll such that an open draw of the web is defined between said first smooth-faced press roll and said second smooth-faced press roll without the interposition of another press nip between said extended nip and said open draw, the web being passed directly into said additional press nip from said extended nip whereby a side of the web contacts said second smooth-faced press roll opposite from the side of the web that contacts said first smooth-faced press roll and dewatering in said additional press nip occurs in an opposite direction to the direction of dewatering in said extended nip.

2. The press section of claim 1, wherein the pick-up felt contacts a side of the web opposite from a side of the web that contacts the forming wire and said first press nip increases the dry solids content of the web by about 5% to about 15%.

3. The press section of claim 1, further comprising a hollow-faced lower roll arranged against said second smooth-faced press roll to form said additional press nip.

4. The press section of claim 1, wherein said hose roll is a hollow-faced press roll having grooves and/or holes provided in an outer face thereof and is situated above said first smooth-faced press roll such that said glide hose operates in a downward direction.

5. The press section of claim 1, wherein the dry solids content of the web entering into said extended nip is in the range of about 25% to about 35% and said extended nip increases the dry solids content of the web by about 15% to about 25%.

6. The press section of claim 1, wherein said extended nip comprises means for pressing the web in an adjustable manner such that a compression pressure curve is formed in which the compression pressure is raised in a first zone in said extended nip in a substantially linear manner to a pressure that is of an order of about 3000 kPa to about 4000 kPa, the compression pressure is then kept substantially constant in a second zone, the compression pressure then increases in a third zone to a peak compression pressure in the middle of said third zone, the peak compression pressure being in the range of between 5000 kPa and about 8000 kPa, the compression pressure is then lowered to zero after the peak pressure is reached.

7. The press section of claim 1, wherein said first press nip removes approximately one half of the total amount of the water contained in the web passing through said first press nip from the web.

8. The press section of claim 1, wherein said first press nip is formed against a portion of a lower half of said smooth-faced center roll such that a run of the web-carrying pick-up felt is upwardly inclined in said first press nip and said suction zone of said suction roll pulls the web-carrying pick-up felt into said first press nip and prevents separation of the web from the pick-up felt by the force of gravity.

9. A method for dewatering a web in a press section of a paper machine and producing paper, comprising the steps of:

transferring a paper web from a forming wire to a pick-up felt running around a pick-up roll provided with a suction zone, forming a first press nip between a suction roll and a smooth-faced press roll after the web is transferred to the pick-up roll without the interposition of another press nip before the first press nip, guiding the pick-up felt around a suction zone of the suction roll into the first press nip, the first press nip constituting the only press nip through which the pick-up felt runs, the suction zone covering a substantial curving sector of the suction roll, said pick-up felt guiding step comprising the steps of guiding the pick-up felt in a first direction into engagement with the suction roll, and then guiding the pick-up felt over the suction zone of the suction roll to reverse the running direction of the pick-up felt, arranging a steam box having a curved face in opposed relationship to at least a portion of the suction zone of the suction roll, transferring the web from the pick-up felt to the smooth-faced press roll at or after the end of the suction zone, loading the first press nip with a low load to provide a loading force between 30 kN/m and 80 kN/m, carrying the web on the smooth-faced press roll and into only a single extended nip formed against the smooth-faced press roll and arranged after the first press nip in the running direction of the web without the interposition of other press nips between the first press nip and the single extended nip, forming the extended nip against .a hose roll comprising a flexible mantle, arranging a hydraulically loaded glide shoe in the mantle of the hose roll, arranging a smooth glide face of the glide shoe against a smooth inner face of the mantle, loading the glide shoe such that the distribution of compression pressure in the extended nip in both the machine direction and in the transverse direction is adjustable so as to optimize the dewatering taking place in the extended nip and control the profiles of properties of the web in the transverse direction, passing a single water-receiving press fabric through the extended nip, controlling the loading of the first press nip and the loading of the extended nip in relation to one another such that the dry solids content of the web is raised to a level sufficient to enable the web to be passed in an open draw, separating the web from the smooth-faced center roll after the extended nip in an open draw without the interposition of another press nip between the extended nip and the open draw, arranging an additional press nip after the extended nip in the running direction of the web, forming the additional press nip between a smooth-faced upper roll and a hollow-faced lower roll, and passing the web into the additional press nip directly from the extended nip such that a side of the web contacts said smooth-faced upper roll opposite from the side of the web that contacts said smooth-faced press roll and dewatering in the additional press nip occurs in an opposite direction to the direction of dewatering of the extended nip.

10. The method of claim 9, further comprising the steps of arranging the water-receiving press fabric at a side of the web opposite a side of the web which contacts the forming wire and removing a substantial amount of water from the web in the first press nip such that the dry solids content of the web after the first press nip rises by about 5% to about 15%.

11. The method of claim 9, further comprising the step of pressing the web in the extended nip in an adjustable manner such that a compression pressure curve is formed in which the compression pressure is raised in a first zone in said extended nip in a substantially linear manner to a pressure that is of an order of about 3000 kPa to about 4000 kPa, the compression pressure is then kept substantially constant in a second zone, the compression pressure then increases in a third zone to a peak compression pressure in the middle of said third zone, the peak compression pressure being in the range of about 5000 kPa to about 8000 kPa, the compression pressure is then lowered to zero after the peak pressure is reached.

12. The method of claim 9, further comprising the step of transferring the web as a short free draw from the smooth-faced press roll to the smooth-faced upper roll.

13. The method of claim 9, further comprising the step of loading the first press nip to remove approximately one half of the total amount of the water contained in the web passing through the first press nip from the web.

14. The method of claim 9, further comprising the steps of:

forming the first press nip against a portion of a lower half of the smooth-faced center roll such that a run of the pick-up felt is upwardly inclined in the first press nip, and applying suction through the suction zone of the suction roll to lead the pick-up felt and web carried thereon into the first press nip and prevent separation of the web from the pick-up felt by the force of gravity.

15. The method of claim 9, further comprising the steps of:

loading the first press nip to remove about one half of the water in the web passing through the first press nip from the web, and loading the extended nip to a loading force of about 10 to 30 times the loading force of the first press nip.

* * * * *